US007210843B2

(12) United States Patent
Friedman

(10) Patent No.: US 7,210,843 B2
(45) Date of Patent: May 1, 2007

(54) MULTIDIRECTIONAL MIXING OF FLUID SAMPLES

(75) Inventor: Mitchell A. Friedman, Randallstown, MD (US)

(73) Assignee: Union Scientific Corporation, Randallstown, MD (US)

( * ) Notice: Subject to any disclaimer, the term of this patent is extended or adjusted under 35 U.S.C. 154(b) by 0 days.

(21) Appl. No.: 11/583,228

(22) Filed: Oct. 19, 2006

(65) Prior Publication Data

US 2007/0036025 A1 Feb. 15, 2007

Related U.S. Application Data

(63) Continuation of application No. 10/983,768, filed on Nov. 8, 2004, which is a continuation-in-part of application No. 10/001,146, filed on Nov. 1, 2001, now abandoned.

(51) Int. Cl.
*B01F 11/00* (2006.01)

(52) U.S. Cl. ..... 366/110; 366/212

(58) Field of Classification Search ..... 366/110–112, 366/208–212, 237, 240, 348
See application file for complete search history.

(56) References Cited

U.S. PATENT DOCUMENTS 1,945,015 A * 1/1934 Wurzbach et al. ..... 310/29
2,539,391 A * 1/1951 Alvord ..... 310/29
2,919,215 A * 12/1959 Neuhaus et al. ..... 134/1
3,106,652 A * 10/1963 Burt ..... 310/17
3,465,974 A * 9/1969 Eckert ..... 241/153
3,769,758 A * 11/1973 McDonald ..... 451/326
5,427,451 A * 6/1995 Schmidt ..... 366/208
6,508,582 B2 * 1/2003 Friedman ..... 366/110
6,659,637 B2 * 12/2003 Friedman ..... 366/212

* cited by examiner

*Primary Examiner*—David Sorkin
(74) *Attorney, Agent, or Firm*—Whiteford, Taylor & Preston L.L.P

(57) ABSTRACT

A method of mixing fluid samples using an electromagnetic multidirectional shaker is provided. The shaker has a first electromagnet driving a first support panel in a first direction, and a second electromagnet driving a second support panel in a second direction. The first electromagnet is affixed to a base and is operatively attached to the first support panel which is suspended from the base via one or more first spring members. The first spring members are configured to bias the first support panel to an at-rest position after it has been displaced by the first electromagnet. The second support panel is in turn supported above the first support panel by one or more second spring members. The second electromagnet is affixed to the first support panel, and is operatively attached to the second support panel. The second spring members are configured to bias the second support panel to an at-rest position after it has been displaced by the second electromagnet.

8 Claims, 8 Drawing Sheets

The mixing currents are entirely inside the vial and mixing the contents occurs.

Contents do not mix (Prior Art)

MULTIDIRECTIONAL MIXING OF FLUID SAMPLES

CROSS-REFERENCE TO RELATED APPLICATIONS

This application is a Continuation of co-pending U.S. patent application Ser. No. 10/983,768, filed Nov. 8, 2004 by the inventor herein and entitled "MULTIDIRECTIONAL MIXING OF FLUID SAMPLES," which is a Continuation-in-Part of U.S. patent applciation Ser. No. 10/001,146, filed Nov. 1, 2001, now abandoned, by the inventor herein and entitled "MULTIDIRECTIONAL SHAKER," the specifications of which are incorporated herein by reference.

BACKGROUND OF THE INVENTION

1. Field of the Invention

The invention disclosed herein relates generally to mixing of fluid samples using shakers for microplates, small diameter test tubes, and like-configured fluid containers, and more particularly to mixing of fluid samples using a multi-directional shaker of simplified construction comprising a support tray resiliently mounted above a base through a plurality of spring members arranged in differing directions, and a plurality of electromagnetic drives or mechanical drives for imparting at least bi-directional vibratory motion to the support tray in order to mix the contents of a microplate or collection of specimen tubes positioned on the support tray, irrespective of the diameter of the microplate wells or tubes.

2. Description of the Background

The processing of biological specimens or chemical products in laboratories often requires the mixing of analytes within a container in order to carry out a desired reaction. Such containers have often comprised beakers or flasks whose contents were traditionally mixed by either manually shaking the beaker or flask, or by using a stirring rod. Other mixing apparatus have included a Teflon coated magnet placed within a beaker or flask and driven magnetically in a rotary motion to mix the beaker or flask contents. Unfortunately, manually shaking the beaker or flask provides insufficient means to control the mixing of the contents and easily results in laboratory technicians accidentally dropping the container and ruining the sample. Likewise, the use of stirring rods has required that the laboratory technician either thoroughly wash the rod between specimens in order to avoid cross-contamination, or throw away and replace disposable rods for applications with large numbers of specimens, making the rapid mixing of large numbers of specimens highly impractical.

In order to overcome these shortcomings, motor driven orbital shakers were developed which enabled a laboratory technician to place a beaker or flask on a motor driven platform that would cause the beaker or flask to travel in a continuous orbit to mix its contents. So long as the diameter of the beaker or flask holding a sample is greater than the orbit diameter of the platform, mixing of the contents will occur. For example, as shown in the schematic view of a prior art orbital mixer of FIG. 1*a*, the center of the flask travels in an orbital path equivalent to the orbit of the platform, and the centrifugal forces on the liquid will reverse every 180° to provide adequate mixing of the contents.

However, as the number of specimens needed to be analyzed in a given time period has grown, the quest for efficiency in the processing of such specimens has resulted in smaller and smaller sample sizes being studied, and thus smaller and smaller containers for holding those samples. Unfortunately, as smaller sized beakers and flasks were used, those orbital shakers having an orbit diameter that was larger than the beaker or flask diameter were shown to be ineffective for mixing the contents. For example, as shown in the schematic view of a prior art orbital mixer of FIG. 1*b*, a beaker or flask having a diameter that is smaller than the orbit diameter of the mixer simply travels in the shaker's orbit, and centrifugal forces drive the liquid contained within the beaker or flask against the side of the container which is furthest from the center of orbit. If there are any suspended solids in the liquid, they will likewise be driven against the outside wall of the container, and fail to mix with the solution. In order to alleviate this problem, a few orbital shakers have been made available having orbit diameters of as little as ⅛".

As the need for processing greater numbers of samples in shorter amounts of time continued to grow, microplates were developed to hold multiple samples of a chemical or biological material to be analyzed in a single, compact structure having a rectangular grid of a large number of distinct "wells." Such microplates are available today in 96-well, 384-well, and even 1536-well configurations. Likewise, racks of small diameter tubes have been developed providing a similar array of specimen-holding chambers. Obviously, the greater the number of wells or tubes in a standard microplate footprint, the smaller the diameter of the well, such that for microplates and tubes having chamber diameters of far less than ⅛", an orbit of far less than ⅛" would likewise be required in order to ensure proper mixing. As was true with orbital mixers for large flasks, the contents of such a small diameter tube rotating in an orbit larger than its own diameter are difficult to mix. Using an orbit larger than the well or tube diameter causes the liquid contents to move to the outside of the orbit and rise up the inner wall of the tube which is closest to the outside radius of the orbit. The contents of the tube begin to spin inside the tube with a relatively small amount of relative motion (or shearing) between adjacent layers of fluid within the walls of the tube. As the orbital speed is increased, the liquid in the tube is forced outward by centrifugal force, rising up the inner wall of the tube until it spills over the top. Given the orbit diameter limitation of only ⅛", traditional horizontal orbital shakers have thus been ineffective in shaking microplates and tube collections having such small diameter chambers.

Given the failure of traditional orbiting mixing apparatus to provide an effective means of mixing the contents of small well microplates and small diameter tubes, attempts have been made to provide mixing apparatus specifically configured for mixing the contents of microplate wells, but unfortunately have also met with little success. For example, U.S. Pat. No. 3,635,446 to Kurosawa et al. discloses a microplate shaking device using an eccentric motor to uncontrollably vibrate a microplate holding plate through a horizontal plane. Likewise, U.S. Pat. No. 4,102,649 to Sasaki discloses a microplate shaker device which pivotally mounts a microplate to a vibration plate, and slidably mounts the microplate atop a number of props. The vibration plate is caused to vibrate by either an electromagnet or an eccentric wheel in a nonlinear, horizontal manner. Further, U.S. Pat. No. 4,264,559 to Price discloses a mixing device for a specimen holder comprising two springlike metal rods upon which a specimen holder is mounted, the rods being fixed at one end in a vertical block, and a weight positioned adjacent the opposite end of the rods. Manually plucking one of the rods imparts a "pendulum-like" vibration to both rods, and thus to the specimen holder. Finally, U.S. Pat. No. 5,921,477 to Tomes et al. discloses an agitating apparatus for a "well plate holder" which comprises a vertically-oriented reciprocating saw as a means for vertically shaking a multi-well plate, and provides agitating members comprising small diameter copper or stainless steel balls within each well.

Unfortunately, none of the known prior art devices have been able to provide controlled, multidirectional vibration to a microplate or collection of small diameter tubes in order to create vibratory motion of sufficient turbulence to thoroughly mix the well or tube contents.

Furthermore, U.S. Pat. No. 5,427,451 to Schmidt discloses a mixer which utilizes a complex, microprocessor-controlled circuit to provide oscillatory drives comprised of permanent magnets and drive coils juxtaposed therewith, with each coil being independently energized by separate variable frequency sources. The drive circuits are configured to alternately attract and repel the permanent magnets so as to provide the oscillatory motion, thus requiring actuation of the drive coils at all times during operation of the mixer. Such a construction is highly complex, requiring precise control of the timing of each drive cycle, and exhibits high energy requirements for its operation. It would be highly advantageous to provide a simplified mixing construction that has a lower energy requirement, but that can still provide consistent, reliable mixing through controlled multidirectional shaking of test specimen containers.

Moreover, effective mixing requires that the layers of fluid within the tube vigorously move relative to each other. Simply driving the tube with a small orbital motion simply rotates the fluid within the tube as a large slug, with the only appreciable relative motion occurring between the tube wall surface and the outermost fluid layer. However, suddenly stopping the orbiting motion will cause the fluid which was driven up the outer tube wall to collapse, causing greater turbulence and thus better mixing. In fact, the rapid on and off cycling of such motion causes the creation of turbulence within the tube which can greatly facilitate the mixing of layers of fluid within the tube. While mechanically driven orbiting mixers have been previously known which attempt to provide such impulse-driven mixing, such devices have not met with commercial success. For example, mechanically driven orbiting mixers have been known which are provided a timer in the motor circuit to periodically stop the unit and then start it again. Such starting and stopping of the drive mechanism is costly, creates much wear and tear on the equipment, and most importantly, is limited as to the speed with which such a device can cycle on and off due to inertia and the ability of a motor to quickly accelerate.

It would therefore be advantageous to provide an electromagnetic, multidirectional shaker of simplified construction which will ensure the efficient mixing of the contents of microplates and small diameter tubes.

SUMMARY OF THE INVENTION

It is, therefore, an object of the present invention to provide a method for mixing fluid samples using a multidirectional microplate and specimen tube shaker which avoids the disadvantages of the prior art.

In accordance with the above object, an electromagnetic multidirectional shaker is disclosed which has a first electromagnet driving a first support panel in a first direction, and a second electromagnet driving a second support panel in a second direction. The first electromagnet is affixed to a base and is operatively attached to the first support panel which is suspended from the base via one or more first spring members. The first spring members are configured to bias the first support panel to an at-rest position after it has been displaced by the first electromagnet. The second support panel is in turn supported above the first support panel by one or more second spring members. The second electromagnet is affixed to the first support panel, and is operatively attached to the second support panel. The second spring members are configured to bias the second support panel to an at-rest position after it has been displaced by the second electromagnet.

In a first preferred embodiment, both the first and second electromagnets and spring members provide substantially linear motions that are perpendicular to one another. Such combination of linear motions impart a horizontal elliptical motion to the second support panel, which motion may be varied in effective diameter simply by adjusting the amplitude of the vibration imparted by either one of the two electromagnets in combination with their associated spring members. A rectified current is applied to each of the electromagnets, such that each electromagnet is cyclically energized and de-energized. In combination with the spring members set forth herein, energizing each electromagnetic drive unit causes retraction of a flange or other member attached to the associated support platform against the bias of at least one spring member, and de-energizing each electromagnetic drive unit allows such spring member to move such support platform in the opposite direction. Thus, each electromagnet need only be energized during half of each vibration cycle, thus eliminating the need for a permanent magnet within the drive assembly and reducing the energy required to operate the assembly. Moreover, it has been found that by tuning the natural frequency of the spring-mass system of a multidirectional shaker according to the embodiments herein to the frequency of the drive signal applied to the electromagnets, greater mixing may be achieved in small well containers. For instance, in cases where a 60 Hz drive signal is supplied (through a rectifier) to the electromagnets, as would be the case when powering a shaker from a standard electrical outlet in the United States, spring members may be selected for inclusion in the shaker apparatus so as to cause the natural frequency of the system to approximate the frequency of that drive signal. By substantially matching the natural frequency of the shaker assembly as a spring-mass system (via selection of spring members having the necessary spring constants) to the drive frequency, significantly improved mixing is achieved beyond that available from prior known shaker assemblies.

In a further embodiment, a control assembly may be provided that cycles the rectified current drive signal supplied to the electromagnetic drive units on and off, preferably between 5 and 20 cycles per second. In other words, and by way of example only, a rectified current drive signal may be supplied to one or both electromagnetic drive units in a series of multiple impulses each second, thus starting and stopping the vibratory motion imparted by each drive unit several times each second, to in turn cause greater mixing of the contents than has previously been available. Furthermore, the control assembly may independently control each of the two electromagnetic drives so as to allow shutting down only one of the two drive units, thus eliminating the centrifugal force but maintaining linear shaking, in turn creating even greater turbulence within the fluid column so as to improve mixing.

In a second preferred embodiment, the first electromagnet and spring members provide substantially linear motion, while the second electromagnet and spring members provide arcuate motion within a plane that is perpendicular to the linear direction imparted by the first electromagnet and spring members. Here, the combination of motions impart a three-dimensionally warped elliptical motion to the second support panel, which motion may again be varied in diameter by adjusting the amplitude of the vibration imparted by either one of the two electromagnets. The arcuate motion applied by the second electromagnetic drive causes a centrifugal force component in the fluid upwards and away from the center of rotation, thus providing even greater mixing.

It should be noted here that, as used above, the term "substantially linear motion" is intended to include the minimally asymtopically arcuate motion of the support panels described herein resulting from their linear displacement from the drive axis of each electromagnetic drive unit and the fixed distance of the spring members. Thus, it is intended that the term "substantially linear motion" involve the motion imported on each support panel as set forth herein as a result of application of the driving force having a drive axis parallel to the major axis of such support panel when the shaker assembly is at rest.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

Figure 1A:
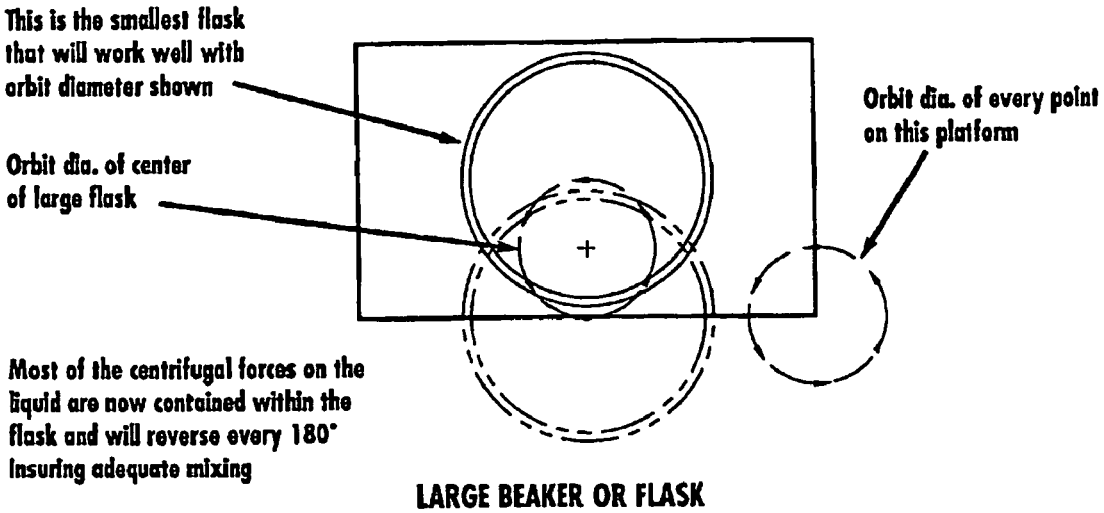
FIG. 1*a* is a top-down schematic view of a prior art orbital specimen shaker.
Figure 1B:
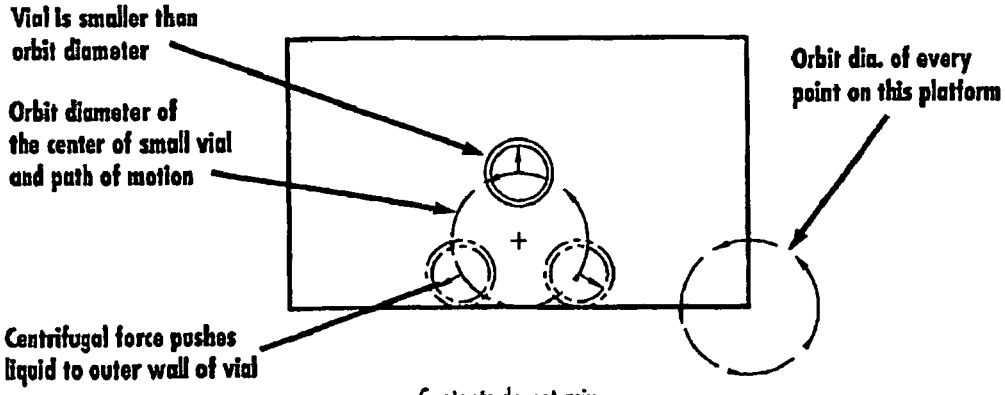
(Prior Art) FIGURE 1b
FIG. 1*b* is a second top-down schematic view of a prior art orbital specimen shaker.
Figure 2:
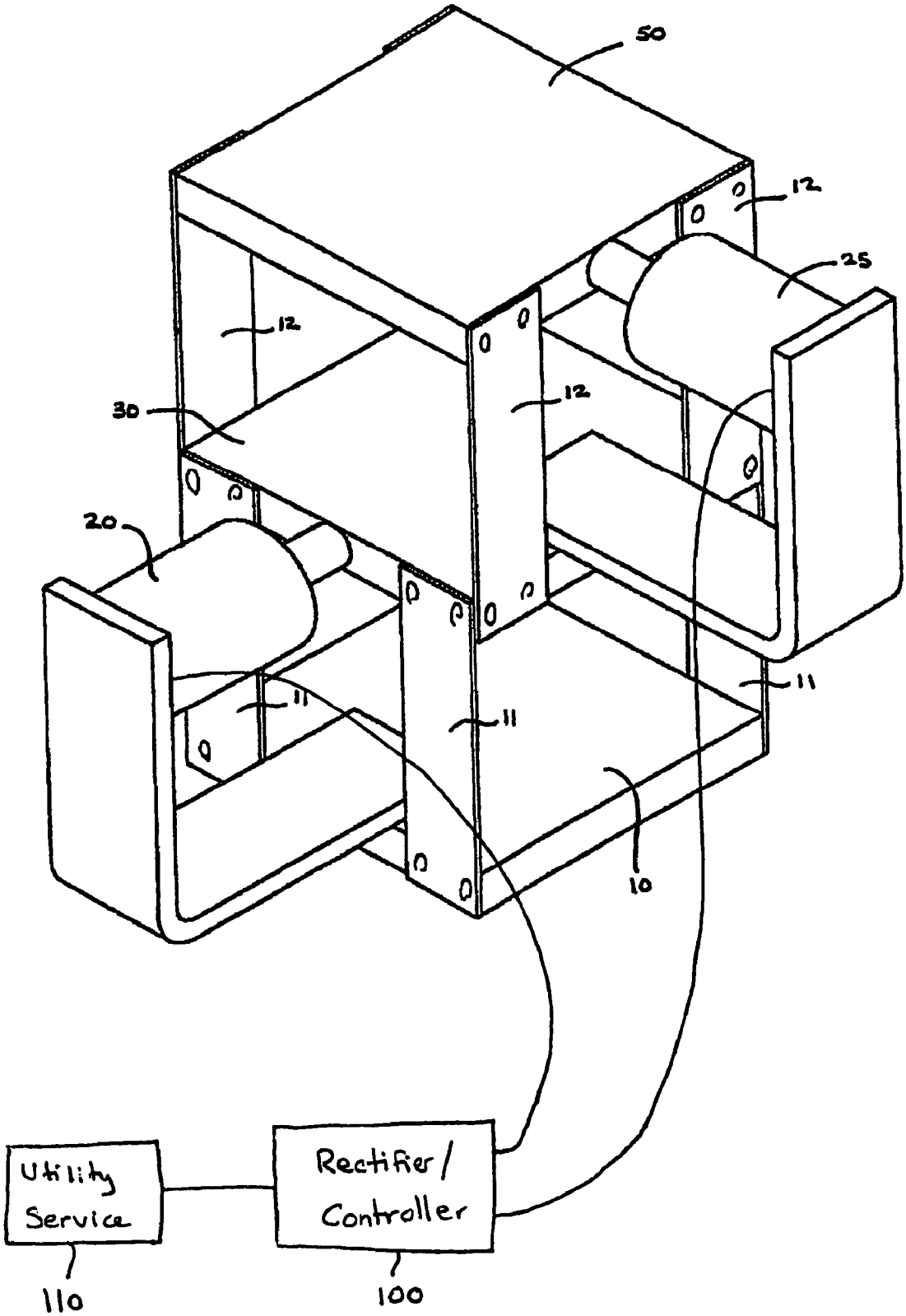
FIG. 2 is a schematic view of an electromagnetic multidirectional shaker according to one aspect of the instant invention.

As shown in the schematic view of FIG. 2, a multidirectional shaker comprises a base 10 to which is affixed a first electromagnetic drive 20. The operative end of electromagnetic drive 20 engages a first support platform 30, which support platform 30 is in turn supported by base 10 via one or more first spring members 11. A second electromagnetic drive 25 is affixed to support platform 30, with its operative end engaging a second support platform 50. Second support platform 50 is in turn supported by support platform 30 via one or more second spring members 12. In operation, power is supplied from a utility service 110, such as a standard 120 volt electrical outlet supplying a 60 Hz signal. That signal is preferably directed through a rectifier (and optional controller) 100 which in turn supplies a rectified current drive signal to each electromagnetic drive unit, as discussed in greater detail below.

Figure 4:
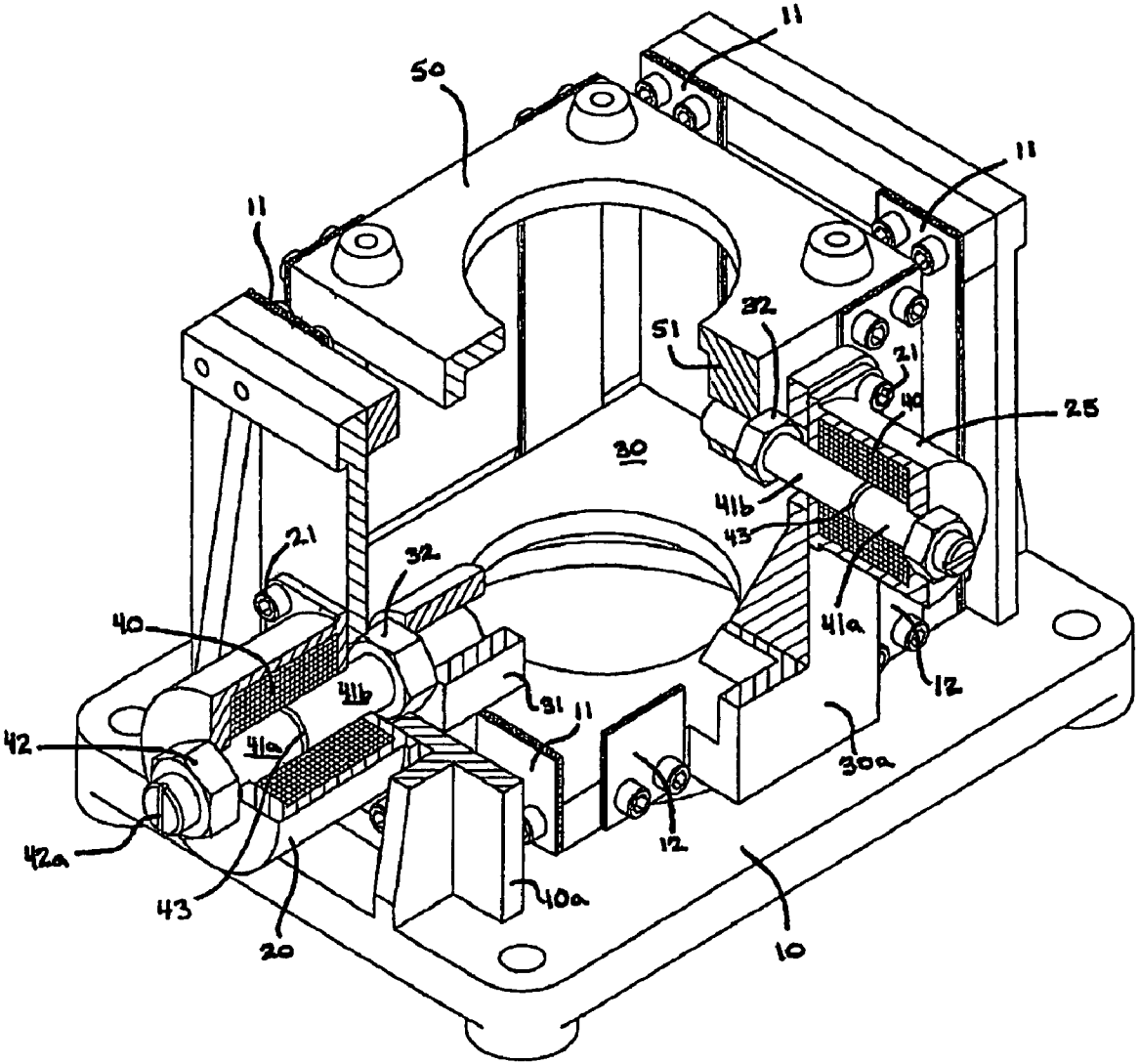
FIG. 4 is a partial sectional view of the shaker of FIG. 3.

As shown more particularly in the partial sectional view of FIG. 4, electromagnetic drive 20 preferably comprises a wire coil 40 encasing a core assembly 41*a*. Core assembly 41*a* is enclosed within a housing which in turn is rigidly attached to an upward extension 10*a* of base 10. An armature assembly 41*b* is positioned opposite core assembly 41*a* a sufficient distance to define an air gap 43 between the core assembly and the armature assembly. Armature assembly 41*b* is in turn rigidly attached to support platform 30, as set forth in greater detail below.

Air gap 43 is preset during construction of base unit 10. However, air gap 43 may inadvertently become either excessively narrow, in which case the core and armature assemblies may contact one another during the shaking operation, or excessively wide, in which case the current of the device may rise to dangerous levels. Thus, in the event that the air gap requires adjustment, a slot 42*a* configured to receive a screwdriver or similar device is provided within an outward extension from core assembly 41*a*. The extension is rotatable through use of a tool such as a screwdriver to either narrow air gap 43 (via clockwise rotation), or to widen air gap 43 (via counterclockwise rotation). The proper air gap is reached when the air gap is as narrow as possible without the core and armature assemblies contacting one another during operation. The position of the extension (and thus the width of the air gap) may be locked in place after adjustment by tightening hex nut 42.

In use, a rectified current drive signal is applied to coil 40, thus energizing the coil for half of a cycle and de-energizing the coil for the remainder of the cycle. As mentioned above, the rectified current drive signal is supplied from rectifier 100 of typical construction, which in turn receives a power signal from utility service 110 (FIG. 2), and which preferably supplies the rectified current drive signal at the same frequency as the power signal, which again in a system configured for operation from a standard 120 volt outlet in the United States would be 60 Hz. When coil 40 is energized, core assembly 41*a* is magnetized and attracts armature assembly 41*b*. As armature assembly 41*b* moves towards core assembly 41*a*, it pulls support platform 30 towards core assembly 41 against the bias of first spring members 11 (preferably in the form of leaf springs), in turn flexing spring members 11. When coil 40 is de-energized, the magnetic pull between core assembly 41*a* and armature assembly 41*b* is released, and spring members 11 return to and pass through their at rest position, in turn pushing support panel 3 outward from core assembly 41. This cycle continues as long as power is supplied to the electromagnetic drive such that support platform 30 is vibrated substantially in the horizontal direction.

As can readily be seen by the schematic view of FIG. 2, vibration of support platform 30 substantially in the horizontal direction likewise causes the vibration of second electromagnetic drive 25 and support platform 50 substantially in the horizontal direction. Second electromagnetic drive 25 may be identical to first electromagnetic drive 20, except that second electromagnetic drive 25 is positioned to operatively engage second support platform 50 instead of first support platform 30. As support platform 30 is vibrated substantially in the horizontal direction, electromagnetic drive 25 and second spring members 12 likewise vibrate support platform 50 substantially in the horizontal direction at a right angle to the direction of support platform 30.

The combined vibrational movements imparted to support platform 30 may take on a variety of forms. For example, if the two platforms are driven in phase (i.e., if one platform begins its movement simultaneously with the other), then the motion generated will simply be a straight line whose motion is the vector sum of the motion of the two individual platforms. However, if the motion of the second platform is delayed until the point where the first platform has completed its travel and before returning, and the return of the first platform is delayed until the second platform completes its travel, and continues to repeat this sequence, then the final motion will become a square (assuming both platform strokes were equal, or a rectangle if not equal). By adjusting the phased relationship of the two platforms, it is easy to create a wide variety of mixing paths including squares, rectangles, straight lines, circles, and ellipses of varying ovalities. Use of the electromagnetic drives 20 and 25 of FIG. 2 easily enables an operator via a controller 100 to electrically adjust both phase and relative amplitude of the individual platforms permitting the user to obtain the ideal multidirectional path to induce mixing of liquid in any size tube.

Figure 3:
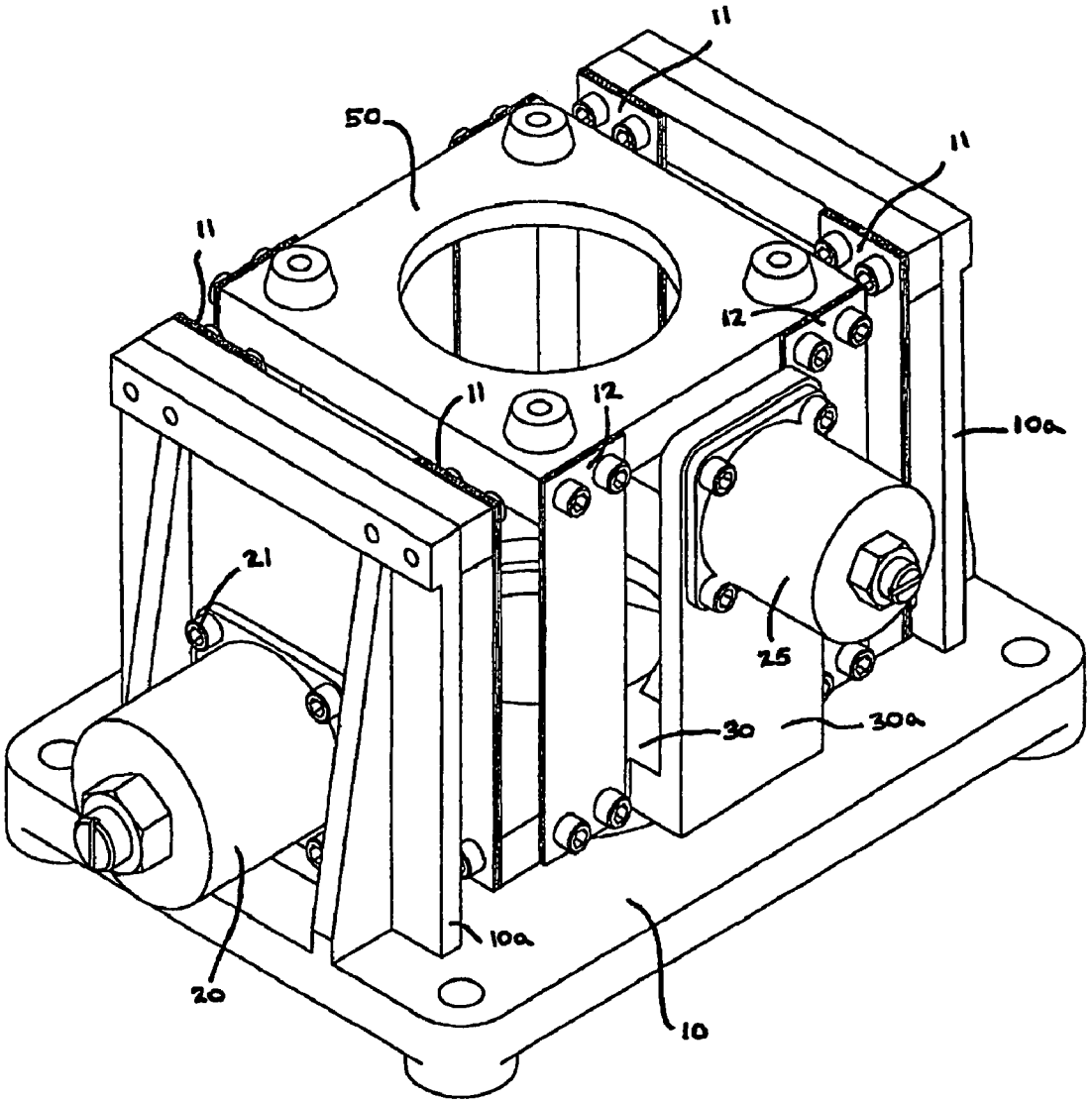
FIG. 3 is a perspective view of a first preferred embodiment of an electromagnetic multidirectional shaker according to one aspect of the instant invention.

As shown in the perspective view of FIG. 3 and the sectional view of FIG. 4, a first preferred embodiment of the instant invention comprises a base 10 having upwardly extending walls 10*a* affixed to both a front and rear end of base 10. Electromagnetic drive 20 is rigidly affixed to one of walls 10*a* of base 10, such as by way of a plurality of threaded members 21. Electromagnetic drive 20 is mounted so that the entirety of the housing for coil 40 is located on the exterior side of wall 10*a*. As shown more particularly in the partial sectional view of FIG. 4, wall 10*a* is provided an opening through which armature 41*b* extends. The end of armature 41*b* opposite core assembly 41*a* is affixed to support platform 30 at flange 31. Flange 31 has a central opening configured to receive the free end of armature assembly 41*b*. A compression nut 32 is threadably attached to armature assembly 41*b* and holds the outer end of armature assembly 41*b* within flange 31, such that horizontal movement of armature assembly 41*b* with respect to core assembly 41*a* imparts substantially horizontal motion to support platform 30 in the same direction.

First spring members 11, preferably in the form of leaf springs, are mounted to the top, inner edge of walls 10*a* and to the bottom, outer edges of support platform 30 adjacent walls 10*a* so as to suspend support platform 30 above base 10, thus allowing movement of support platform 30 with respect to base 10.

Support platform 30 is provided a single upwardly extending wall 30*a*. Second electromagnetic drive 25 is rigidly affixed to wall 30*a*, such as by way of a plurality of threaded members 21. Second electromagnetic drive 25 is mounted so that the entirety of the housing for coil 40 is located on the exterior side of wall 30*a*. As with walls 10*a*, wall 30*a* is provided an opening through which armature 41*b* of second electromagnetic drive 25 extends. The end of armature 41*b* of second electromagnetic drive 25 opposite core assembly 41*a* is affixed to a downwardly extending flange 51 of support platform 50. Flange 51 has a central opening configured to receive the outer end of armature assembly 41*b*. A compression nut 32 is threadably attached to armature assembly 41*b* of second electromagnetic drive 25, and holds the outer end of armature assembly 41*b* within flange 51, such that horizontal movement of armature assembly 41*b* with respect to core assembly 41*a* of second electromagnetic drive 25 imparts horizontal motion to support platform 50 in the same direction.

To optimize mixing, spring members 11 and 12 are preferably selected so as to cause the natural frequency of the shaker assembly to approximate the frequency of the drive signal supplied from utility service 110 and through rectifier (and optional controller) 100. More particularly, for a drive signal having a known frequency (e.g., 60 Hz from a standard electrical outlet in the United States), spring members 11 and 12 may be selected having a spring constant that causes the natural frequency of the system to approximate the frequency of the drive signal. It has been found that by so tuning the natural frequency of the system to the frequency of the drive signal, the system may achieve far greater mixing that prior known systems, and that by rectifying such drive signal and relying on the spring members alone to move each support platform through half of each cycle (as opposed to using a powered motor or drive unit to move each support platform through their entire cycle), the system may achieve such greater mixing with less power consumption.

Figure 5:
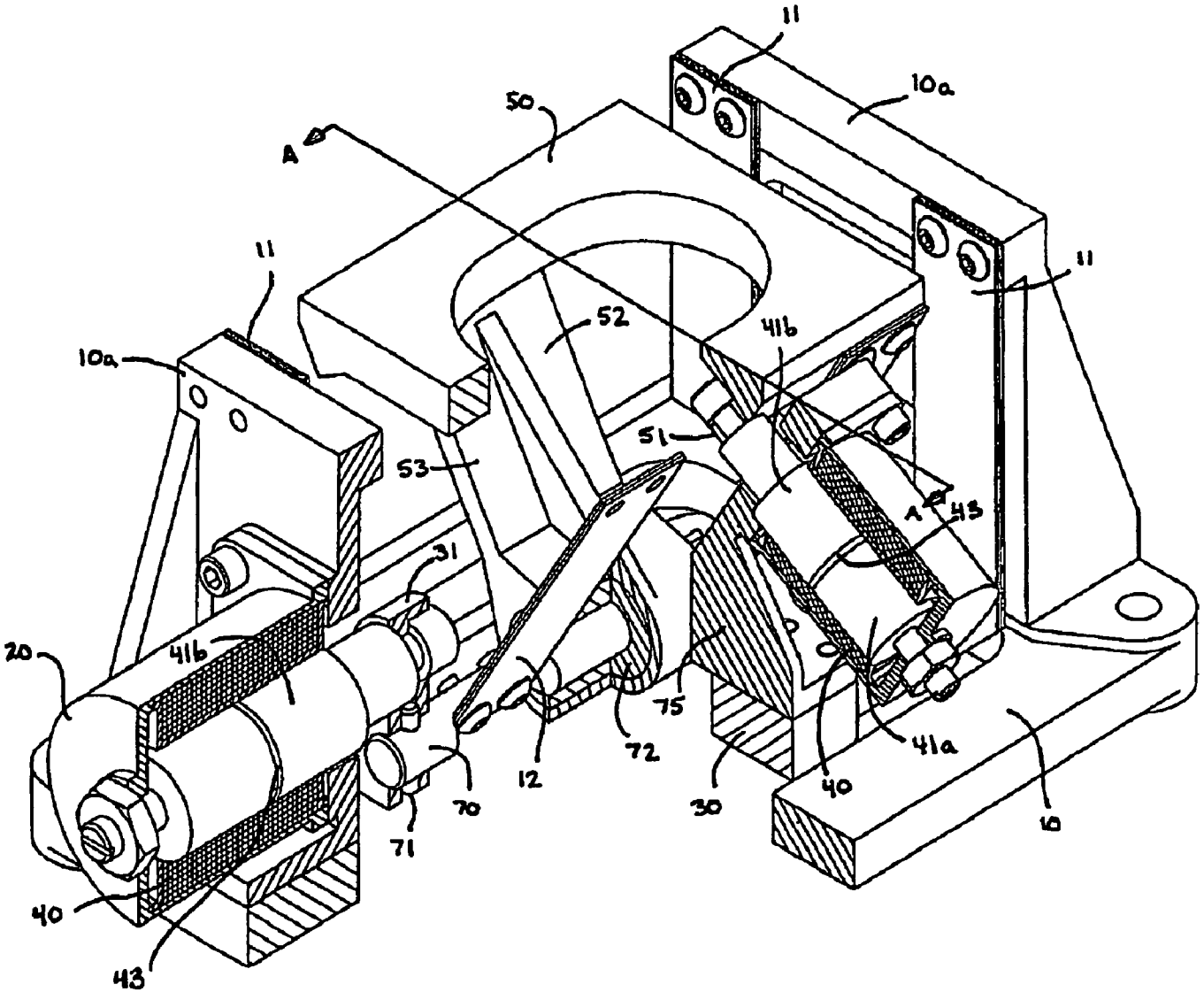
FIG. 5 is a partial sectional view of a second preferred embodiment of an electromagnetic multidirectional shaker according to one aspect of the instant invention.
Figure 6:
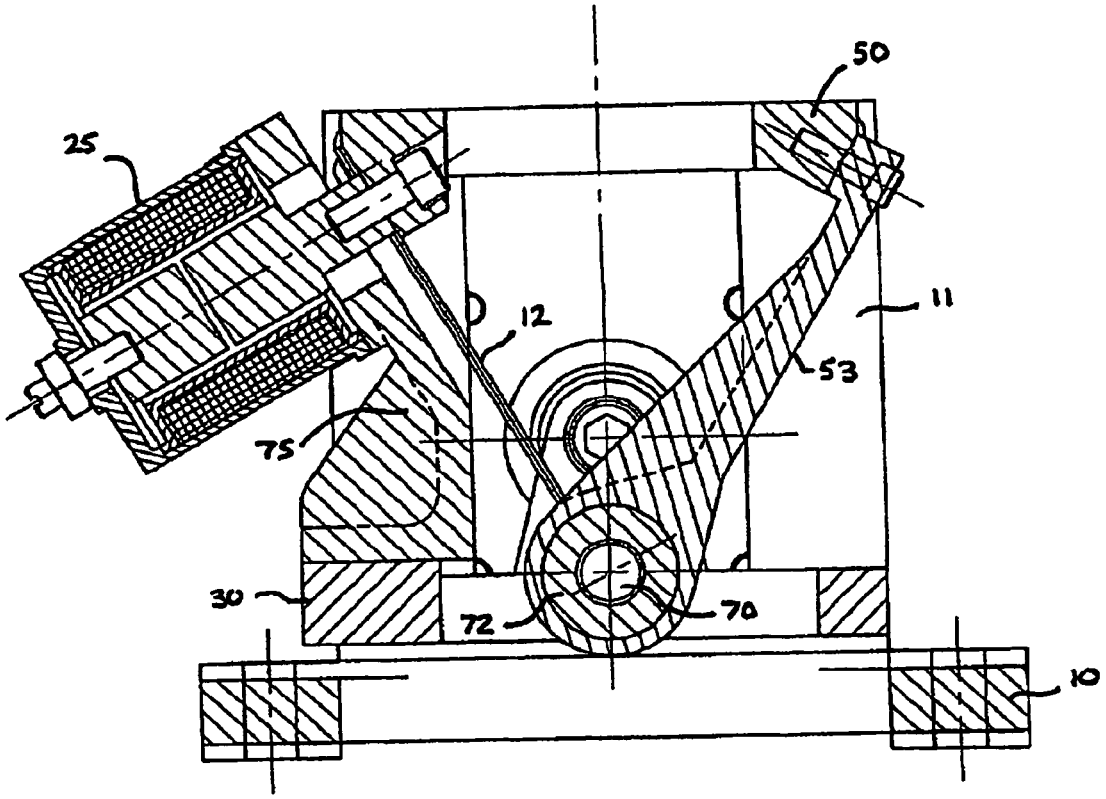
FIG. 6 is a side sectional view along line A—A of FIG. 5.

As shown in the perspective sectional view of FIG. 5 and the side sectional view of FIG. 6, a second preferred embodiment of the instant invention provides base 10, first electromagnetic drive 20, and first spring members 11 which are essentially identical to those components shown in FIGS. 3 and 4 and bearing like reference numerals. However, while the embodiment shown in FIGS. 3 and 4 provides substantially planar elliptical motion to support platform 50 by summing first and second substantially horizontal motions imparted by the first and second electromagnetic drives 20 and 25, the embodiment of FIGS. 5 and 6 provides a three-dimensionally warped elliptical motion to support platform 50 by summing a substantially horizontal motion imparted by first electromagnetic drive 20 with an arcuate motion within a plane perpendicular to the horizontal motion imparted by second electromagnetic drive 25.

In the second preferred embodiment shown in FIG. 5, support platform 30 comprises a generally rectangular frame at its base having an upwardly extending flange 31 for receiving the outer end of armature assembly 41*b* of first electromagnetic drive 20. Support platform 30 is again suspended from base walls 10*a* by first spring members 11. Support platform 30 is provided a first bore hole directly below flange 31 and extending through the side wall of platform 30, and a second bore hole at the opposite side of the frame and aligned with the first opening. A shaft 70 extends through the bore holes in support platform 30. A locking pin 71 is inserted through shaft 70 at either end within the side wall of support platform 30 so as to prevent rotation of shaft 70 with respect to support platform 30.

Support platform 30 is also provided an upwardly extending bracket 75 for mounting second electromagnetic drive 25 at an angle with respect to the horizontal plane. Bracket 75 is provided an opening through which armature 41*b* of second electromagnetic drive 25 extends. The end of armature 41*b* opposite core assembly 41*a* of second electromagnetic drive 25 is affixed to support platform 50 at angled flange 51. Angled flange 51 has a central opening configured to receive the outer end of armature assembly 41*b*, and affixes the outer end of armature assembly 41*b* thereto, such that movement of armature assembly 41*b* with respect to core assembly 41*a* of second electromagnetic drive 25 imparts motion to support platform 50 in the same direction (i.e., at the same angle to the horizontal plane as drive 25).

Support platform 50 is pivotally attached to support platform 30 in the following manner. One side of support platform 50 is provided downwardly extending arms 52 and 53 which, at their bases, are pivotally mounted on shaft 70. A bearing or elastomer bushing 72 is preferably provided between the shaft 70 and the hollowed opening at the bottom of each of arms 52 and 53 to facilitate the free rotation of arms 52 and 53 about shaft 70. Arms 52 and 53 may be removably attached to support platform 50, such as by one or more screws, bolts, or other fastening members, or may alternately be molded in a single piece therewith. The opposite side of support platform 50 is provided downwardly extending second spring members 12 which, at their bases, are fixedly attached to shaft 70 via one or more screws, bolts, or other fastening members. With this mounting structure, support platform 50 is capable of pivotal movement about shaft 70 under the force of electromagnetic drive 25, but is biased towards an at-rest position by spring members 12. Thus, under the force of electromagnetic drive 25 and spring members 12, support platform 50 is vibrated through an arc rather than a straight line, which arc has a centrifugal force component upwards and away from the center of rotation, such that the microplate wells or tubes positioned on support platform 50 are moved in a three-dimensional circular or elliptical path whose ends are bent downwards out of the horizontal plane, further facilitating the creation of a vortex within the fluid to even further enhance mixing.

Figure 7:
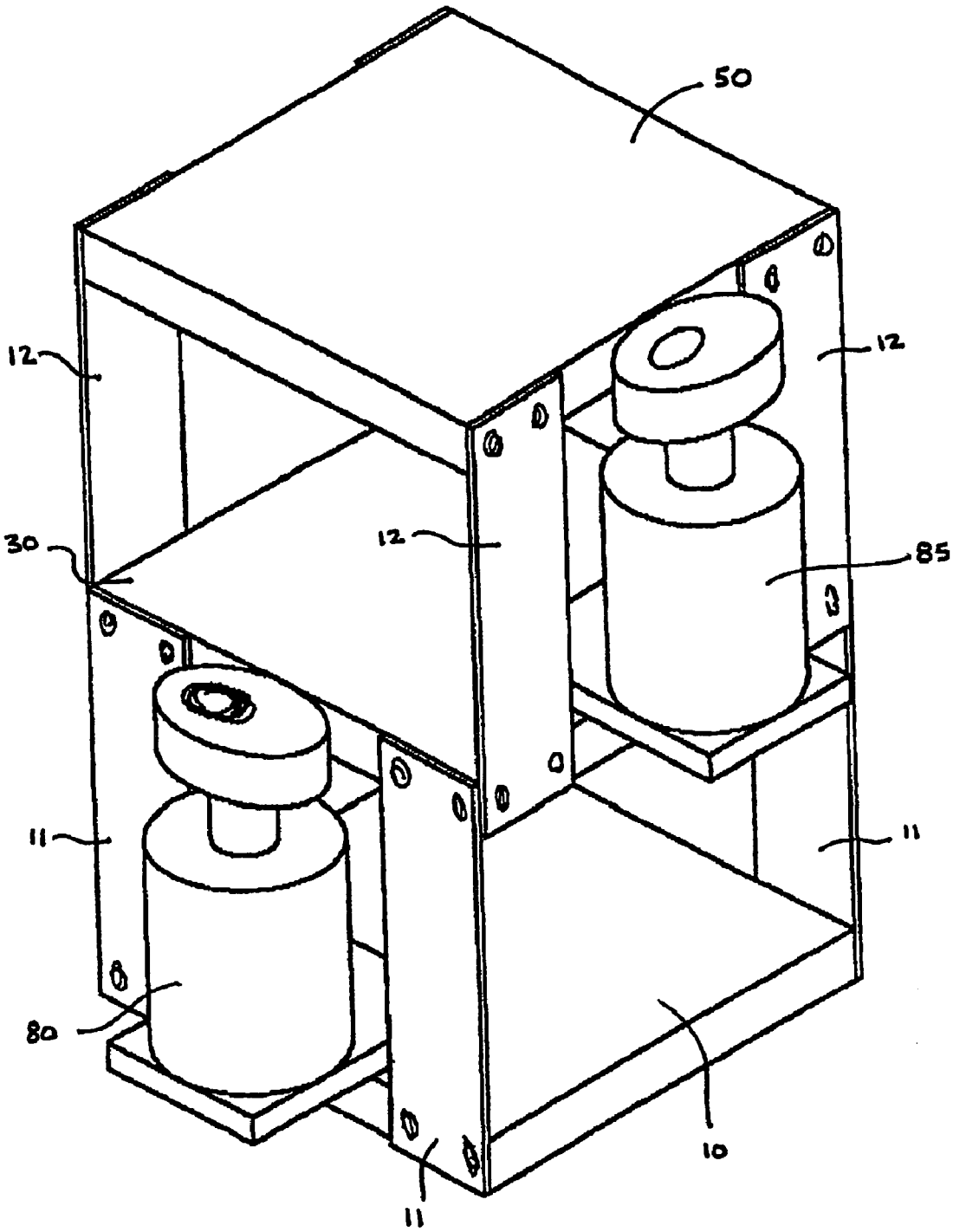
FIG. 7 is a schematic view of a mechanical multidirectional shaker according to one aspect of the instant invention.

It should also be noted that, in an alternate embodiment, a shaker in accordance with one aspect of the instant invention may be operated entirely by mechanical driving means. As shown in the schematic view of FIG. 7, a mechanical multidirectional shaker of the instant invention comprises a base 10 to which is affixed a first mechanical drive 80 in the form of a rotating cam of conventional construction. The cam of first mechanical drive 80 engages first support platform 30, which support platform 30 is in turn supported by base 10 via one or more first spring members 11. A second mechanical drive 85 is affixed to support platform 30, with its cam engaging second support platform 50. Second support platform 50 is in turn supported by support platform 30 via one or more second spring members 12.

Just as with the electromagnetically-actuated embodiment of the multidirectional shaker of the instant invention, vibration of support platform 30 under the force of first mechanical drive 80 and first spring members 11 likewise cause the vibration of second mechanical drive 85 and support platform 50 in the same direction. Second mechanical drive 85 may be identical to first mechanical drive 80, except that second mechanical drive 85 is positioned to operatively engage second support platform 50 instead of first support platform 30. As support platform 30 is vibrated in the horizontal direction, mechanical drive 85 and second spring members 12 likewise vibrate support platform 50 in the horizontal direction at a right angle to the direction of support platform 30.

Figure 8:
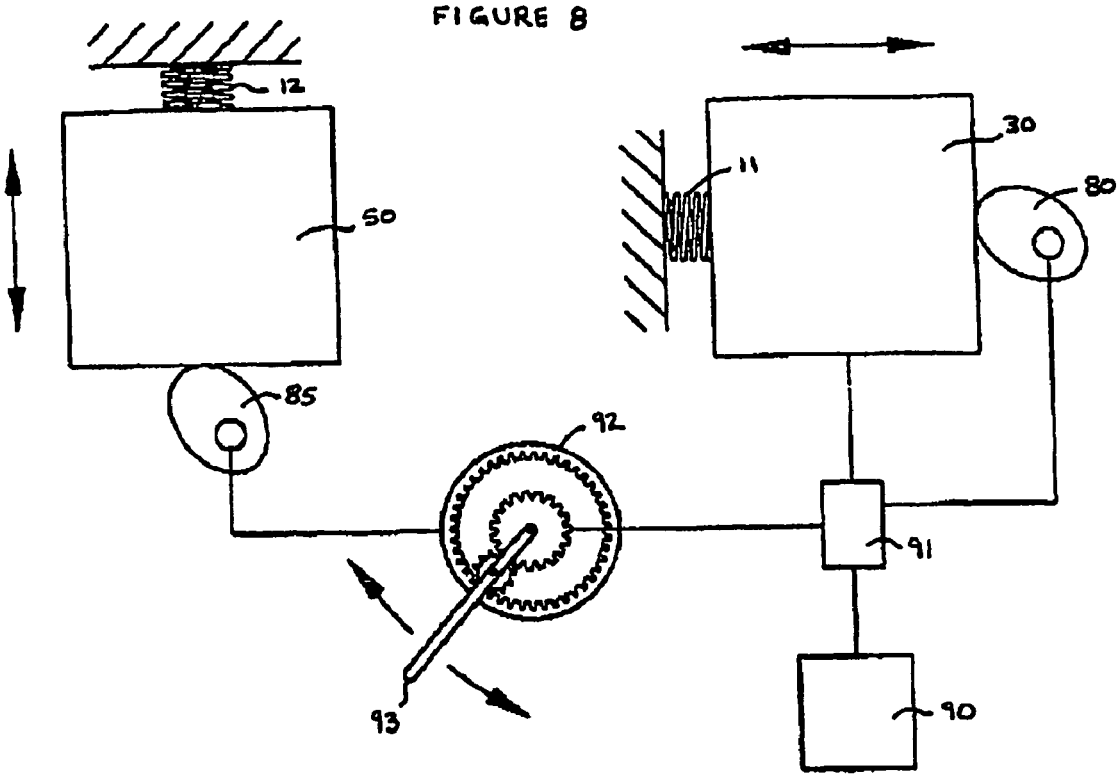
FIGS. 8 and 9 are schematic flow charts showing the operation of the shaker of FIG. 6.

As shown in the schematic flow chart of FIG. 8, such a mechanical multidirectional shaker may be operated to provide varying multidirectional mixing path geometries. For instance, a motor 90 may provide power output to a gear box 91, which transfers power to first mechanical drive 80 to vibrate (in combination with spring members 11) platform 30 in a first direction. Gear box 91 simultaneously transfers power to a gear differential 92, which in turn transfers power to second mechanical drive 85 to vibrate (in combination with spring members 12) platform 50 in a second direction at a right angle to the first direction. The power input into gear differential 92 may be adjusted, such as by way of a manual lever 93, to enable varying the phase of the two mechanical drives so as to provide a multitude of mixing path geometries to suit varying mixing requirements.

Figure 9:
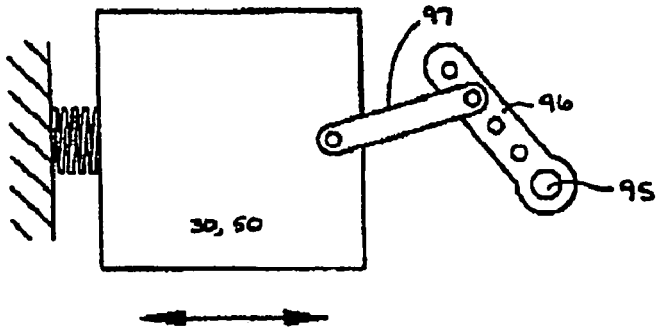

As shown in the schematic flow chart of FIG. 9, alternate mechanical driving means may be provided in the form of a crank 96 rotating about a crank shaft 95, and operatively connected to either of support platforms 30 or 50, via a connecting rod 97, all of conventional construction. In this case, the shaking amplitude of platforms 30 and 50 may again be easily adjusted by moving connecting rod 97 to various locations on crank 96 and in conjunction with gear differential 92 of FIG. 8, enabling a multitude of mixing path geometries to suit varying mixing requirements.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. By way of example, while each embodiment herein shows driving the two support platforms 30, 50 in orthogonal directions with respect to one another, one of the panels could alternately be driven in a direction other than at a right angle to the other panel, without departing from the spirit and scope of the instant invention. It should be understood, therefore, that the invention may be practiced otherwise than as specifically set forth herein.

The invention claimed is:

1. A method for mixing a fluid sample, comprising the steps of:

(a) providing a multidirectional shaker comprising a base;

a first wall extending upwardly from said base;

a first electromagnetic drive unit lacking a permanent magnet and comprising a first housing affixed to said first wall, a first core assembly within said first housing, a first coil surrounding said first core assembly, and a first armature assembly adjacent said first core assembly and configured for displacement toward and away from said first core assembly, said first armature assembly operatively engaging a first support platform so as to move said first support platform in a first substantially horizontal direction;

at least one first spring member between said first wall and said first support platform positioned to move said first support platform in a second direction opposite said first direction;

a second wall extending upwardly from said first support platform;

a second electromagnetic drive unit lacking a permanent magnet and comprising a second housing affixed to said second wall, a second core assembly within said second housing, a second coil surrounding said second core assembly, and a second armature assembly adjacent said second core assembly and configured for displacement toward and away from said second core assembly, said second armature assembly operatively engaging a second support platform so as to move said second support platform in a third direction; and at least one second spring member between said first support platform and said second support platform positioned to move said second support platform in a fourth direction opposite said third direction;

(b) connecting said multidirectional shaker to a power supply supplying a drive signal at a fixed drive signal frequency, wherein said at least one first spring member and said at least one second spring member further comprise spring members having spring constants that cause a natural frequency of said multidirectional shaker to approximate said fixed drive signal frequency;

(c) positioning a fluid sample on said second support platform;

(d) supplying said drive signal to said first and second coils to respectively magnetize said first and second core assemblies to respectively attract said first and second armature assemblies to said first and second core assemblies, and to respectively move said first and second support platforms in said first and third directions;

(e) terminating said drive signal to cause said at least one first spring member and said at least one second spring member to respectively move said first and second support platforms in said second and fourth directions; and (f) repeating steps d and e to mix said fluid sample.

2. The method of claim 1, wherein said third direction further comprises a substantially horizontal direction that is orthogonal to said first direction.

3. The method of claim 1, wherein said first drive axis of said first electromagnetic drive unit is situated horizontally, and said second drive axis of said second electromagnetic drive unit is situated at an angle to a horizontal plane extending through said first drive axis.

4. The method of claim 3, wherein said second wall mounts said second electromagnetic drive unit such that said second axis is positioned at an angle with respect to said second support platform.

5. The method of claim 1, wherein said second wall mounts said second electromagnetic drive unit such that said second axis is positioned at an angle with respect to said second support platform.

6. The method of claim 1, wherein said drive signal further comprises a rectified current drive signal.

7. The method of claim 1, further comprising the steps of:

(g) terminating step (f);

(h) restarting step (f); and (i) repeating steps (g) and (h) multiple times each second.

8. The method of claim 7, where step (i) is performed between 5 and 20 times per second.

* * * * *